US010047464B2

(12) United States Patent
Hiza

(10) Patent No.: US 10,047,464 B2
(45) Date of Patent: Aug. 14, 2018

(54) HAND SEWING NEEDLE HAVING PERIODIC MARKINGS AND PROCESS FOR USING SAME

(71) Applicant: Nicole Lynn Hiza, Baltimore, MD (US)

(72) Inventor: Nicole Lynn Hiza, Baltimore, MD (US)

( * ) Notice: Subject to any disclaimer, the term of this patent is extended or adjusted under 35 U.S.C. 154(b) by 43 days.

(21) Appl. No.: 15/250,134

(22) Filed: Aug. 29, 2016

(65) Prior Publication Data

US 2017/0284004 A1 Oct. 5, 2017

Related U.S. Application Data

(60) Provisional application No. 62/314,902, filed on Mar. 29, 2016.

(51) Int. Cl.

| | |
|---|---|
| ***D05B 85/02*** | (2006.01) |
| ***D05B 85/12*** | (2006.01) |
| ***B21G 1/02*** | (2006.01) |

(52) U.S. Cl.

CPC ..... *D05B 85/02* (2013.01); *B21G 1/02* (2013.01); *D05B 85/12* (2013.01)

(58) Field of Classification Search

CPC ..... D05B 85/00–85/14; B21G 1/00; B21G 1/003; B21G 1/006; B21G 1/02; B21G 1/04; A61B 17/06

See application file for complete search history.

(56) References Cited

U.S. PATENT DOCUMENTS

| | | | | | |
|---|---|---|---|---|---|
| 2,721,014 | A * | 10/1955 | Allen | D05B 85/02 | 223/102 |
| 3,233,800 | A * | 2/1966 | Catania | A43D 5/08 | 223/102 |
| 4,117,791 | A * | 10/1978 | Current | D05B 85/12 | 112/222 |
| 5,320,608 | A * | 6/1994 | Gerrone | A61B 17/3417 | 604/117 |
| 6,189,747 | B1 * | 2/2001 | Collingham | D05B 85/00 | 223/102 |
| 6,520,389 | B1 * | 2/2003 | Bowman | D05B 85/00 | 112/202 |
| 6,904,773 | B1 * | 6/2005 | Cushman | D04B 3/02 | 66/1 A |

FOREIGN PATENT DOCUMENTS

| | | | |
|---|---|---|---|
| BG | 780775 | A * | 8/1957 |
| JP | 11156079 | A * | 6/1999 |
| JP | 2004283277 | A * | 10/2004 |

* cited by examiner

*Primary Examiner* — Ismael Izaguirre

(74) *Attorney, Agent, or Firm* — Kilpatrick Townsend & Stockton LLP

(57) ABSTRACT

Embodiments of the present invention relate to hand sewing needles that have periodic markings to facilitate the creation of stitches of equal length and spacing. Because regular stitching can be difficult to produce by hand but is nevertheless necessary for a garment or other sewing product to be considered of quality, presentable, and professionally made, embodiments of the invention aid those with little sewing experience in producing regular stitching. Embodiments of the present invention also relate to methods for producing and using the disclosed hand sewing needle.

6 Claims, 5 Drawing Sheets

HAND SEWING NEEDLE HAVING PERIODIC MARKINGS AND PROCESS FOR USING SAME

CROSS-REFERENCES TO RELATED APPLICATIONS

This application claims the benefit of U.S. Provisional Application No. 62/314,902, filed on Mar. 29, 2016. The entirety of this application is incorporated by reference herein.

FIELD OF THE INVENTION

Embodiments of the present invention relate generally to hand sewing needles and to processes for using same. Specifically, embodiments of the present invention relate to hand sewing needles with striated markings at intervals along the length of the needle that allow for greater precision in stitch length and spacing while sewing by hand.

BACKGROUND OF THE INVENTION

Various types of sewing needles have been developed and used throughout history. Hand sewing needles have been used ubiquitously for a variety of tasks, including sewing, altering, hemming, embroidering, darning, or repairing the fabric of a garment or other sewing product. Various improvements have been made to facilitate sewing with needles by hand. Many of these improvements facilitate threading needles. For example, U.S. Pat. No. 815,170 discloses a sewing needle with an open eye, which comprises a channel through which thread can be pulled. U.S. Pat. No. 4,385,575 discloses a sewing needle with an eyelet that comprises a clip member to facilitate easy threading of the needle.

There remains, however, a need for a needle that facilitates the production of regular stitches. In most sewing products, stitching must be neat in order for the product to be presentable and to retain its value. A garment that has been sewn with irregular stitches is not presentable and may render the garment unwearable or the product otherwise unusable. For example, a United States military uniform that has been altered with sloppy stitches may cause the uniform to be considered "Out of Service." Stitches must be regular and neat to be considered professional.

Regular stitches, i.e. stitches that have the same length and spacing, such as those a sewing machine makes, render a garment or other sewing product presentable and ensure a quality appearance. Because not everyone has access to or experience with sewing machines, hand sewing may be required or preferred. In hand sewing, regular stitches can be difficult or impossible for someone without extensive sewing experience to produce.

In view of the foregoing, the need exists for a device that may aid in the creation of stitches with regular length and spacing.

SUMMARY OF THE INVENTION

Thus, embodiments of the invention are directed toward hand sewing needles with periodic markings along the elongated body of the needle. These periodic markings are designed to give the user an indication of the length of the needle, so that the user can better understand how much of the needle has passed through a piece of fabric while in use.

The present invention can therefore be used to produce stitches of regular length and spacing.

According to some embodiments of the invention, a needle is provided. The needle comprises an elongated body having a first end and a second end. The elongated body extends between the first end and the second end and includes a point at the first end. The needle further comprises an eyelet positioned within the elongated body at the second end. The needle further comprises periodic markings along the elongated body between the first end and the second end. The periodic markings are spaced along the elongated body with a predetermined distance between each periodic marking.

According to some embodiments of the invention, a method of producing a needle is provided. The method comprises providing the needle. The needle comprises an elongated body having a first end and a second end. The elongated body extends between the first end and the second end and includes a point at the first end. The needle further comprises an eyelet positioned within the elongated body at the second end. The method further comprises creating periodic markings on the elongated body between the first end and the second end.

According to some embodiments of the invention, a method of using a needle is provided. The method comprises providing the needle. The needle comprises an elongated body having a first end and a second end. The elongated body extends between the first end and the second end and includes a point at the first end. The needle further comprises an eyelet positioned within the elongated body at the second end. The needle further comprises a plurality of periodic markings along the elongated body between the first end and the second end. The plurality of periodic markings are spaced along the elongated body with a predetermined distance between each of the plurality of periodic markings. The method further comprises threading the needle with thread by passing the thread through the eyelet of the needle. The method further comprises inserting the point of the needle into fabric at a first location. The method further comprises guiding the needle through the fabric until a first periodic marking of the plurality of periodic markings has entirely passed through the fabric. The method further comprises tilting the needle, and inserting the point of the needle into the fabric at a second location. The method further comprises guiding the needle through the fabric until a second periodic marking of the plurality of periodic markings has entirely passed through the fabric.

BRIEF DESCRIPTION OF DRAWINGS

These and other objectives, features, and advantages of the present invention are described in the following detailed description of the specific embodiments and are illustrated in the following Figures in which.

DETAILED DESCRIPTION OF THE INVENTION

Figure 1:
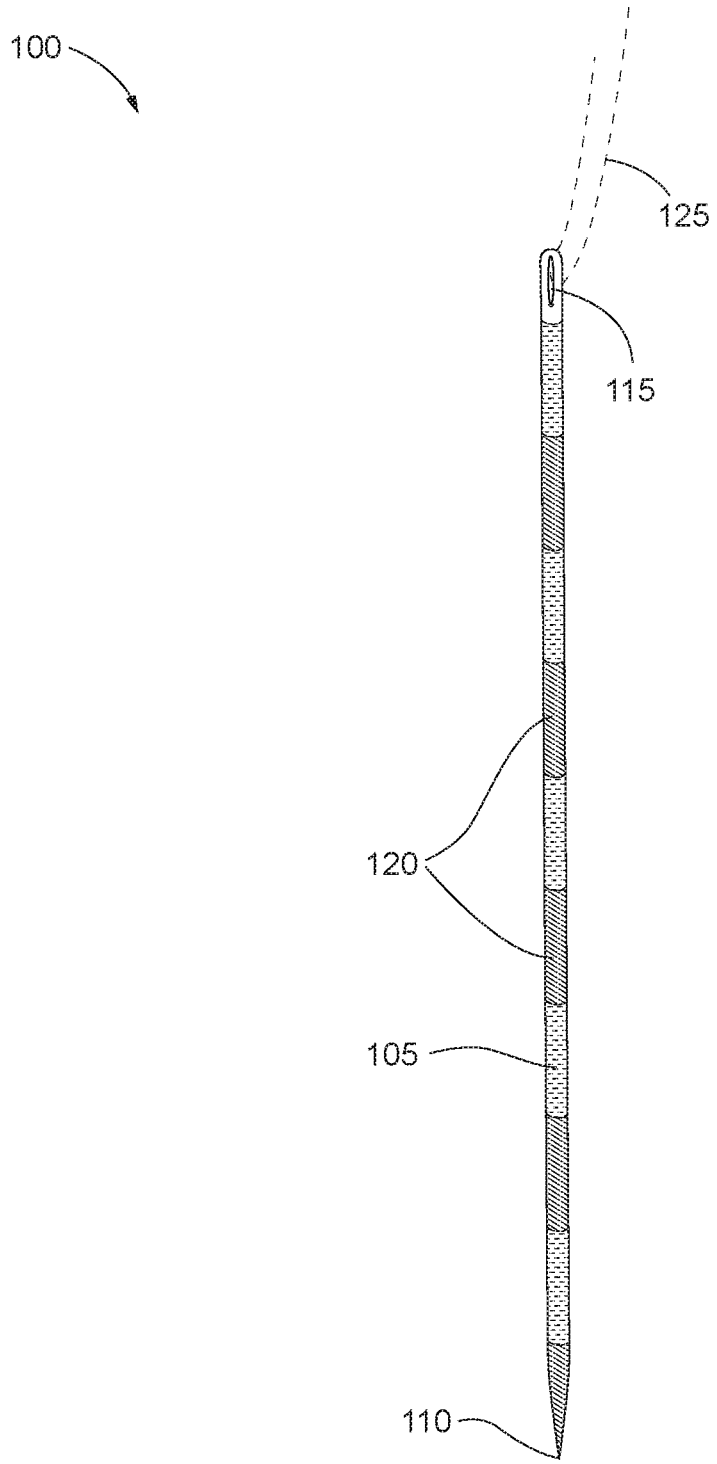
FIG. 1 shows a top view of a hand sewing needle in accordance with an embodiment of the present invention, shown with thread.

In the following description, for the purposes of explanation, specific details are set forth in order to provide a thorough understanding of embodiments of the invention. However, it will be apparent that various embodiments may be practiced without these specific details. The figures and description are not intended to be restrictive.

The ensuing description provides exemplary embodiments only, and is not intended to limit the scope, applicability, or configuration of the disclosure. Rather, the ensuing description of the exemplary embodiments will provide those skilled in the art with an enabling description for implementing an exemplary embodiment. It should be understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, processes and other components may be shown as components in block diagram form in order not to obscure the embodiments in unnecessary detail. In other instances, well-known processes, algorithms, structures, and techniques may be shown without unnecessary detail in order to avoid obscuring the embodiments.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in a figure. A process may correspond to a method, a function, a procedure, a subroutine, a subprogram, etc. When a process corresponds to a function, its termination can correspond to a return of the function to the calling function or the main function.

I. Introduction

Regular stitches, i.e. stitches of regular length and spacing, are necessary to ensure the quality and aesthetic desirability of a garment or other sewing product. Sewing machines can be used to prepare regular stitching, but many people do not have access to a sewing machine or lack the necessary experience to effectively use a sewing machine. For these people, an available alternative is to sew by hand. Creation of regular stitches by hand sewing can nevertheless be difficult. Particularly among inexperienced sewers, who are often more likely not to have access to or experience with a sewing machine, preparing stitches of even length and spacing can be a serious struggle. But because regular stitches remain necessary for quality and desirability, there exists a need for an invention that facilitates the creation of regular stitches when sewing by hand.

The hand sewing needle having periodic markings according to embodiments of the invention meet this need and others. In embodiments of this device, periodic markings striate a hand sewing needle. Because these periodic markings are of equal length and are evenly spaced along the needle, they provide a clear indication to the user of the length of the needle that is being used in each stitch. By relying on the periodic markings to make stitches, e.g., by making a stitch equivalent to the length of each periodic marking, the user can easily prepare evenly spaced stitches of equal length. This device may be particularly useful for inexperienced sewers, who might not be able to reliably gauge the length of their stitches without a visual indication. With use of this needle, even inexperienced users can sew, alter, hem, or mend garments with even, regular stitching. Although described herein with respect to sewing, it is contemplated that the needles described herein may be used alternatively or additionally for any other suitable purpose, e.g., beading, upholstery, etc.

II. Hand Sewing Needle Having Periodic Markings

FIG. 1 illustrates a hand sewing needle 100 according to an embodiment of the present invention, which includes an elongated body 105, a point 110 at a first end, and an eyelet 115 at a second end. The needle includes periodic markings 120, which are separated at intervals along the elongated body 105 between the first end and second end. These markings enable a user to make regular stitches in fabric while sewing, i.e., stitches of even spacing and length. This regularity in stitching improves the overall quality of the finished product. Although shown as having a straight, cylindrical elongated body 105, it is contemplated that needle 100 may be of any shape. For example, needle 100 may be curved, flat, bent, and/or the like along any portion or the entirety of elongated body 105.

In some embodiments, the elongated body 105 is cylindrical in shape with a substantially circular cross-sectional shape. However, it is contemplated that the cross-section may be of any shape, e.g., oval, rectangular, square, etc. The elongated body 105 may be of any length. However, in specific embodiments of the invention, the elongated body 105 has a length between 1 inch and 12 inches, inclusive. The gauge, i.e., the diameter at midshaft, of the elongated body 105 may similarly be any size. However, in specific embodiments of the invention, elongated body 105 has a gauge between 0.0145 inches and 0.092 inches, inclusive. The length and gauge of the needle may be selected based on the type of thread or fabric with which the needle is intended to be used, for example, or according to any other criteria.

The material of the needle 100 is not limited. According to some embodiments of the invention, needle 100 is made of a metal or combination of metals. In some embodiments, the needle is made of steel and may or may not be plated with an additional metal, e.g. nickel, copper, gold, platinum, and the like.

In some embodiments, the needle 100 may be made of plastic or other non-metallic components, possibly in combination with metallic components. Examples of plastics that may be used include polyethylene (PE), polyethylene terephthalate (PET), polyvinyl chloride (PVC), polyamides (PA), polycarbonate (PC), or combinations thereof. Plastic needles may be useful, for example, for use by children.

As shown in FIG. 1, the needle 100 comes to a point 110 at its first end. The length of the taper and the width of the point 110 are not limited. In some embodiments, the length of the taper and width of the point 110 may be selected based upon the type of material with which the needle 100 is to be used. For example, when the material is woven fabric having a relatively fine thread count, the point 110 may have a relatively small width. In alternative embodiments, the point 110 is dull or blunt, and thus the width of the point is relatively large and does not include much of a taper, if any taper at all. For example, when the material is a knit fabric, the point 110 may have a relatively large width.

As shown in FIG. 1, the eyelet 115 of the needle 100 is an opening at the second end of the elongated body 105, through which thread 125 can be passed. The eyelet 115 may be of varying shapes and sizes. In some embodiments, the eyelet 115 is small so as to allow the needle 100 to pass through fabric with ease and without damaging the fabric. In some embodiments of present invention, the eyelet 115 is substantially oval, but in other embodiments, eyelet 115 may be another shape, e.g., a circle, rectangle, square, etc. In some specific embodiments of the invention, the eyelet 115 may have a length between 0.635 inches and 0.6545 inches, inclusive, and a width between 0.011 inches and 0.061 inches, inclusive. In some embodiments, the shape and size of the eyelet 115 may be selected based on the type of thread or fabric with which the needle 100 is intended to be used.

In some embodiments, the user may use any desired thread when using the needle 100, and thread of any material may be used, e.g., cotton, polyester, silk, wool. Similarly, in some embodiments, the user may use any desired fabric in conjunction with needle 100.

In order to facilitate users in the creation of regular stitches, embodiments of the present invention include periodic markings 120 along the elongated body 105 of the hand sewing needle 100. The following term definitions are provided and apply to the periodic markings 120. As used herein, ordinal numeration of periodic markings 120, i.e., "first," "second," etc., begins from the first end of the elongated body 105 and continues toward the second end. The "beginning" of a periodic marking 120 refers to the portion of the periodic marking 120 closest to the first end of the elongated body 105, and the "end" of a periodic marking 120 refers to the portion of the periodic marking 120 closest to the second end of the elongated body 105.

The periodic markings 120 may take any shape or form. In some embodiments, the periodic markings 120 are smooth, i.e. not raised, and serve as indications of distance along the needle 100 from the first end to the second end. In some embodiments, the periodic markings 120 may take the form of numbers affixed along the elongated body 105. These numbers may indicate the distance along the needle, e.g. by indicating the distance of the periodic marking from the first end. Alternatively, these numbers may ordinate the periodic markings 120, by indicating the first periodic marking 120, the second periodic marking 120, the third periodic marking 120, etc. Although shown and described as having a particular number of periodic markings 120, it is contemplated that any number of periodic markings 120 may be included on needle 100.

In some embodiments, the periodic markings 120 take the form of hash marks, i.e., thin stripes that trace the circumference of the elongated body 105. These hash marks may be of any color; each hash mark may be a unique color; all the hash marks may be of uniform color; and/or a combination of colors may be used. In embodiments wherein the hash marks are uniquely colored, the colors may be used to indicate spacing of the hash marks along the elongated body 105 or to ordinate the hash marks. In some embodiments, the hash marks may be paired with numerical indicia on the elongated body 105 to indicate the distance along the needle or to ordinate the hash marks. In an exemplary embodiment of this type, the periodic markings 120 may be hash marks of uniform color and each hash mark may be paired with a numerical indicium which indicates the distance of the hash mark from the first end of the elongated body 105. In this embodiment, the hand sewing needle 100 may resemble a ruler.

In some embodiments, as shown in FIG. 1, the periodic markings 120 take the form of thick stripes that trace the circumference of the elongated body. These stripes are prominent and noticeable, minimizing the risk of user error. These stripes may be of any color; each stripe may be a unique color; all the stripes may be of uniform color; and/or a combination of colors may be used. In embodiments wherein the stripes are uniquely colored, the colors may be used to indicate spacing of the stripes along the elongated body 105 or to ordinate the stripes. Alternatively, the stripes may be paired with numerical indicia on the elongated body 105 to indicate the distance along the needle 100 or to ordinate the stripes. In some embodiments, as shown in FIG. 1, the periodic markings 120 are of uniform color and lack numerical indicia.

In some embodiments of the hand sewing needle 100, each of the periodic markings 120 is separated by an equivalent distance. Such embodiments facilitate the creation of regular stitches, because the periodic markings indicate at which points along the needle 100 the user should pass the needle 100 through the fabric so as to ensure regular intervals and thereby regular stitches. The distance between each periodic marking 120 in these examples is not particularly limited. In some embodiments, the distance between each periodic marking may be any distance less than 1", inclusive, e.g. 0.75", 0.5", 0.25", 0.1875", 0.125", etc.

In some embodiments, the periodic markings 120 may be separated by variable distances, possibly with indications of the length along the needle. In these embodiments, the distance between the periodic markings 120 may vary, but the periodic markings 120 may otherwise indicate the distance along the elongated body 105, e.g., by numerical indication, by differently shaped or formed periodic markings 120, by differently colored periodic markings 120, etc. The distance between each of the periodic markings 120 may vary, but in some specific embodiments, the distance may be between 3/16 inches and ½ inches, inclusive.

In some embodiments, the distance between each periodic marking 120 may be filled by additional sets of periodic markings 120. In these embodiments, the various sets of periodic markings 120 may be separated along the elongated body 105 as above described. In some embodiment, there may be no unfilled space between the periodic markings 120; rather, each periodic marking 120 abuts another periodic marking 120 of a different set. The sets of periodic markings 120 preferably differ in a visibly noticeable manner, e.g., in form, shape, color. This may be more aesthetically appealing to the user as well as providing a clearer contrast, to ensure that the user can see the periodic markings 120 on the needle 100. In embodiments of this type, there may be two sets of periodic markings 120, each taking the above-described form of thick stripes. In this embodiment, each set of stripes may be of equal length but of a different color, and the periodic markings 120 are adjacent to each other. The elongated body 105 of the needle 100 would therefore be entirely covered in stripes of alternating colors. In some embodiments, the colors of the stripes may be chosen such that there is a stark contrast. This would minimize user error, because it would render the periodic markings 120 on the hand sewing needle 100 more noticeable to the user.

III. Process for Manufacturing Hand Sewing Needle Having Periodic Markings

The manner of applying periodic markings to a needle is not substantially limited. Any number of methods may be used to create the periodic markings on a hand sewing needle.

Figure 2A:
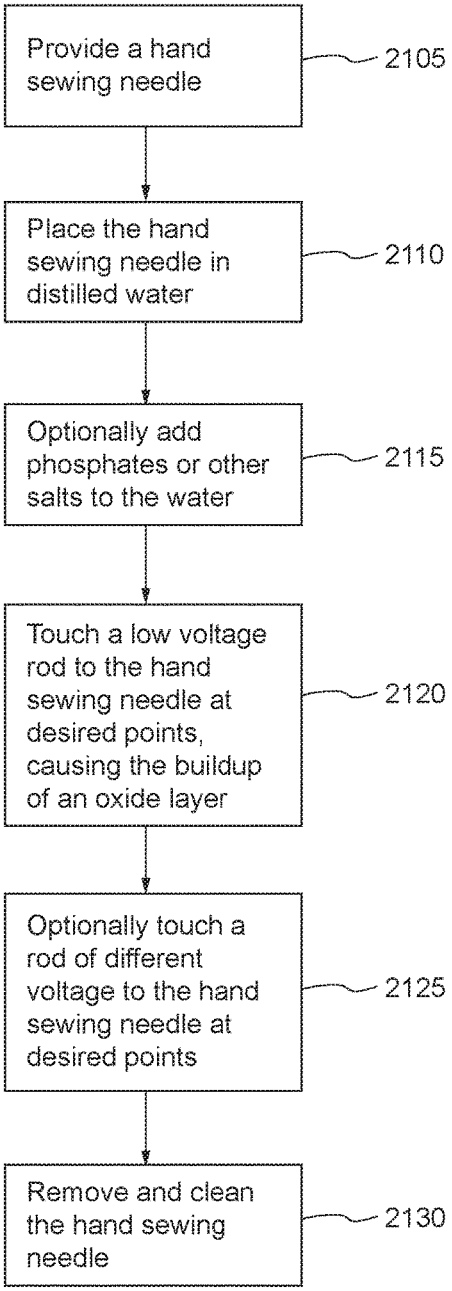
FIGS. 2A-2D show exemplary flows for processes of manufacture of the hand sewing needle of FIG. 1 in accordance with embodiments of the present invention.

FIG. 2A shows an exemplary flow diagram for a process for applying periodic markings to a needle. The flow diagram describes the application of periodic markings by oxidation of selected portions of the elongated body. Those skilled in the art will recognize that this flow diagram illustrates only one method of selective oxidation of a metal. Any other method, including other methods of oxidation, may be utilized to apply periodic markings to the needle. In some embodiments, the needle described with respect to FIG. 2A is needle 100 of FIG. 1.

At step 2105, an untreated hand sewing needle is obtained. In this embodiment, the needle is made of a metallic substance. In some embodiments, the needle may be made of a non-metallic substance that is plated with metal. At step 2110, the needle is placed in water, such as distilled water. In some embodiments, deionized water, purified water, or any other water may be used. At optional step 2115, salts, such as phosphates, may be added to the water. In some embodiments, other salts or electrolytes, or a combination thereof, may be added to the water. The optional additives may improve the conductivity of the water and facilitate the oxidation. At step 2120, a low voltage rod is touched to the needle, causing an oxide layer to build up on the needle. In some embodiments, a copper rod is used, but other metals may be used. The oxide layer that forms appears as a different color on the needle. By applying the rod to specific points along the elongated body of the needle, the periodic markings may be formed as desired. For example, the rod can be touched to the needle at intervals of 0.125" to create evenly spaced periodic markings. At optional step 2125, a rod of different voltage may be touched to the needle at desired points. The use of differing voltages causes differing degrees of oxidation. This may appear as different colors on the needle and may be used to create more elaborately designed periodic markings. For example, the use of two different voltages may allow for the creation of a hand sewing needle with stripes of alternating colors.

Figure 2B:
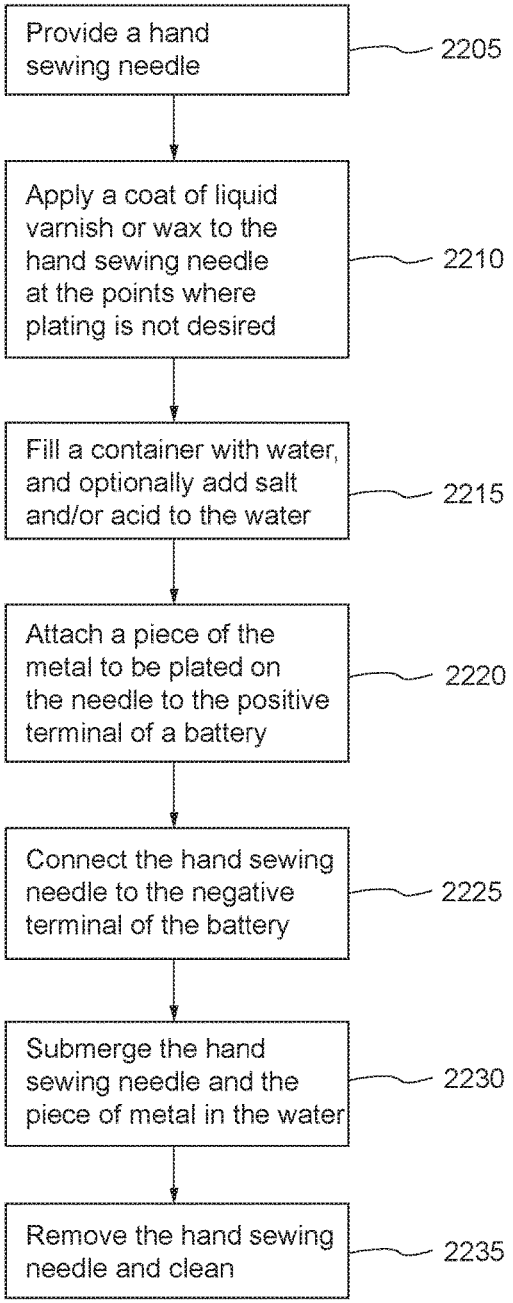

FIG. 2B shows an exemplary flow diagram for a process for applying the periodic markings to the needle according to some embodiments. The flow diagram illustrates the application to the needle by selective electroplating. Electroplating is a process that uses electric current to reduce dissolved metal cations so that they form a coherent metal coating. This flow diagram illustrates only one method of selective electroplating on a metal. Any other method of electroplating may be utilized to apply periodic markings to the needle. For example, one method of electroplating copper onto zinc is disclosed in U.S. Pat. No. 3,664,933, which is incorporated herein in its entirety.

At step 2205, an untreated hand sewing needle is obtained. In this embodiment, the needle is made of a metallic substance. In some embodiments, the needle may be made of a non-metallic substance that is plated with metal. At step 2210, a coat of liquid varnish or wax is applied to the hand sewing needle at the points where plating is not desired. An exemplary substance is beeswax, but any varnish, e.g., enamel paint or nail polish, may be used. By applying this coat, the surface of the metal is obscured and will not be plated. The portions of the needle that remain uncovered will be the sites of the periodic markings. An alternative to application of this coat is to apply an ink coating using transfer paper. At step 2215, a container is filled with water, to which salt and/or acid may optionally be added. The optional additives may improve the conductivity of the water and facilitate the electroplating. At step 2220, a piece of metal is attached to the positive terminal of a battery. This metal will be the metal that is electroplated onto the needle. A variety of metals may be used, e.g., manganese, iron, copper, cobalt, zinc, chromium, tin, cadmium, silver, gold, platinum, at the like, and combinations thereof. The selected metal may be attached to the battery in any manner, such as by using insulated electrical wire and alligator clips. At step 2225, the hand sewing needle is attached to the negative terminal of the battery. The needle may be attached to the battery in any manner, such as by using insulated electrical wire and alligator clips. In some embodiments, the electrical wire may be long enough to submerge the entirety of the needle in the container of water. At step 2230, both the piece of metal and the hand sewing needle are submerged in the container of water. In some embodiments, the hand sewing needle may be fully submerged in the water, but the piece of metal need not be completely submerged. By submerging these in the water, an electrolytic cell is created. Positively charged cations from the piece of metal, which functions as the cathode, become attracted to the negatively charged needle, which functions as the anode. These cations flow toward and attach to the needle. With time, these cations build up to form a plate of metal about the exposed portions of the needle. To facilitate the even distribution of this plate, the water may be stirred. At step 2235, the needle is removed from the water, detached from the battery, and cleaned to remove the coat. The method of cleaning may vary with the type of coat used, e.g., acetone may be used to remove nail polish or an alcohol-based solution may be used to remove the wax.

Figure 2C:
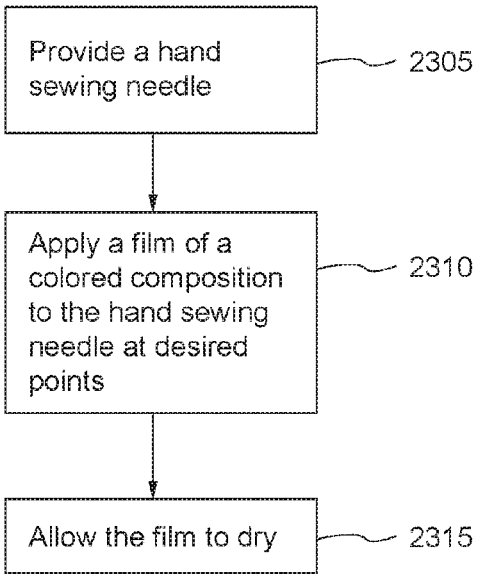

FIG. 2C shows an exemplary flow diagram for a process of applying periodic markings to the needle according to some embodiments. The flow diagram illustrates application onto the needle by applying a liquid, liquefiable, or mastic composition. The composition used may dry to form a solid, visibly distinct, solid film. Exemplary compositions include paint, ink, or colored wax. Compositions such as these are typically inexpensive and easy to use. Different colors of paint or ink can create the necessary contrast of the periodic markings. This flow diagram illustrates only one method applying such a composition to the needle. Any other method may be utilized to apply periodic markings to the needle.

At step 2305, an untreated hand sewing needle is obtained. In this embodiment, the material makeup of the needle is not limited. Whereas above disclosed processes may use a metallic, semi-metallic or metallic plated needle to ensure electric conductivity, any type of needle may be used with the flow diagram of FIG. 2C. Certain types of materials may require specific compositions, e.g., a plastic needle may require the use of a composition that readily adheres to plastics. However, a needle of any material composition may be used. At step 2310, a film of the desired colored composition is applied to the needle at desired points. Compositions that may be used include paints (e.g., acrylic paint), ink, dyes, lacquer, colored wax (e.g. crayons), and the like, or combinations thereof. These can be applied by hand or by machine at desired intervals along the elongated body of the needle. Any variety of tools can be used to apply the composition to the needle, e.g., brushes, sponges, pens, markers, etc. At step 2315, the film is allowed to dry and adhere to the needle.

Figure 2D:
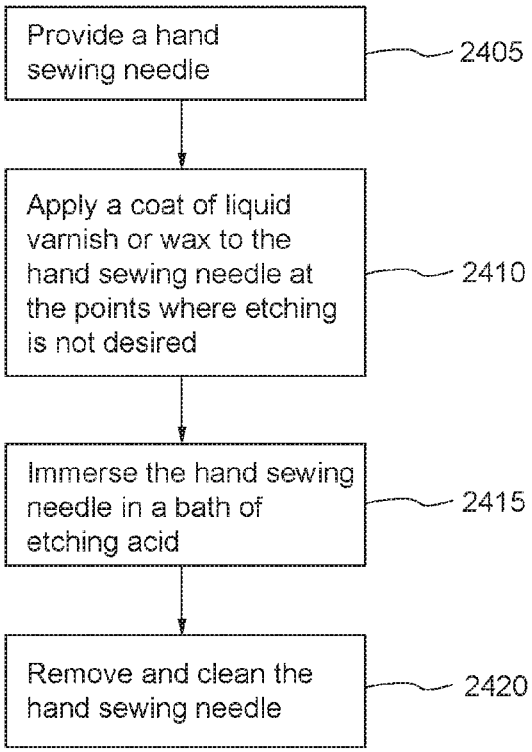

FIG. 2D shows an exemplary flow diagram for a process of applying periodic markings to the needle according to some embodiments. The flow diagram illustrates application by etching the hand sewing needle at desired points. Etching removes outer layers of the needle, typically with the use of chemical etchants, but alternatively or additionally with the use of mechanical devices, to create the periodic markings along the elongated body of the needle. The flow diagram described with respect to FIG. 2D discloses chemical etching. However, any other method of etching may be utilized to apply periodic markings to the needle. For example, one method of making patterned metal coatings by etching selected portions of metal is disclosed in U.S. Pat. No. 3,647,508, which is incorporated herein in its entirety. Etching the hand sewing needle may provide a tactile indication as well as a visual indication of the how far to pass the needle through the fabric.

At step 2405, an untreated hand sewing needle is obtained. In this embodiment, the needle is made of a metallic substance. However, in some embodiments, the needle may be made of a non-metallic substance that is plated with metal. For other chemical etching processes or for mechanical etching processes, a needle of any other material makeup may be used. At step 2410, a coat of liquid varnish or wax is applied to the hand sewing needle at the points where plating is not desired. An exemplary substance is beeswax, but any varnish, e.g., enamel paint, nail polish, and the like, may be used. By applying this coat, the surface of the metal is obscured and will not be etched. The portions of the needle that remain uncovered will be the sites of the periodic markings. In some embodiments, an ink coating may be applied using transfer paper. At step 2415, the needle is immersed in a bath of etching acid. Exemplary etching acids include muriatic acid, nitric acid, sulfuric acid, and the like. The solution may also be prepared using non-acids that form acid in water, such as ferric chloride, copper sulfate, and the like. The acidity of the acid solution generally determines the rate at which the needle will be etched, i.e., a solution of high acidity will etch the needle more rapidly. At step 2420, the needle is removed from the acid solution and cleaned. Cleaning begins with removing the acid, typically by running the needle under water. If a particularly strong acid solution was used, the acid may first be neutralized with a base, e.g. baking soda, and then run under water. Subsequent cleaning may vary with the type of coat used, e.g., acetone may be used to remove nail polish or an alcohol-based solution may be used to remove the wax.

Any of these processes or combinations thereof may be used to apply periodic markings to a hand sewing needle. This listing is not meant to limit the method of application; rather, any means of applying the periodic markings to the needle may be used.

IV. Process for Using Hand Sewing Needle Having Periodic Markings

Figure 3:
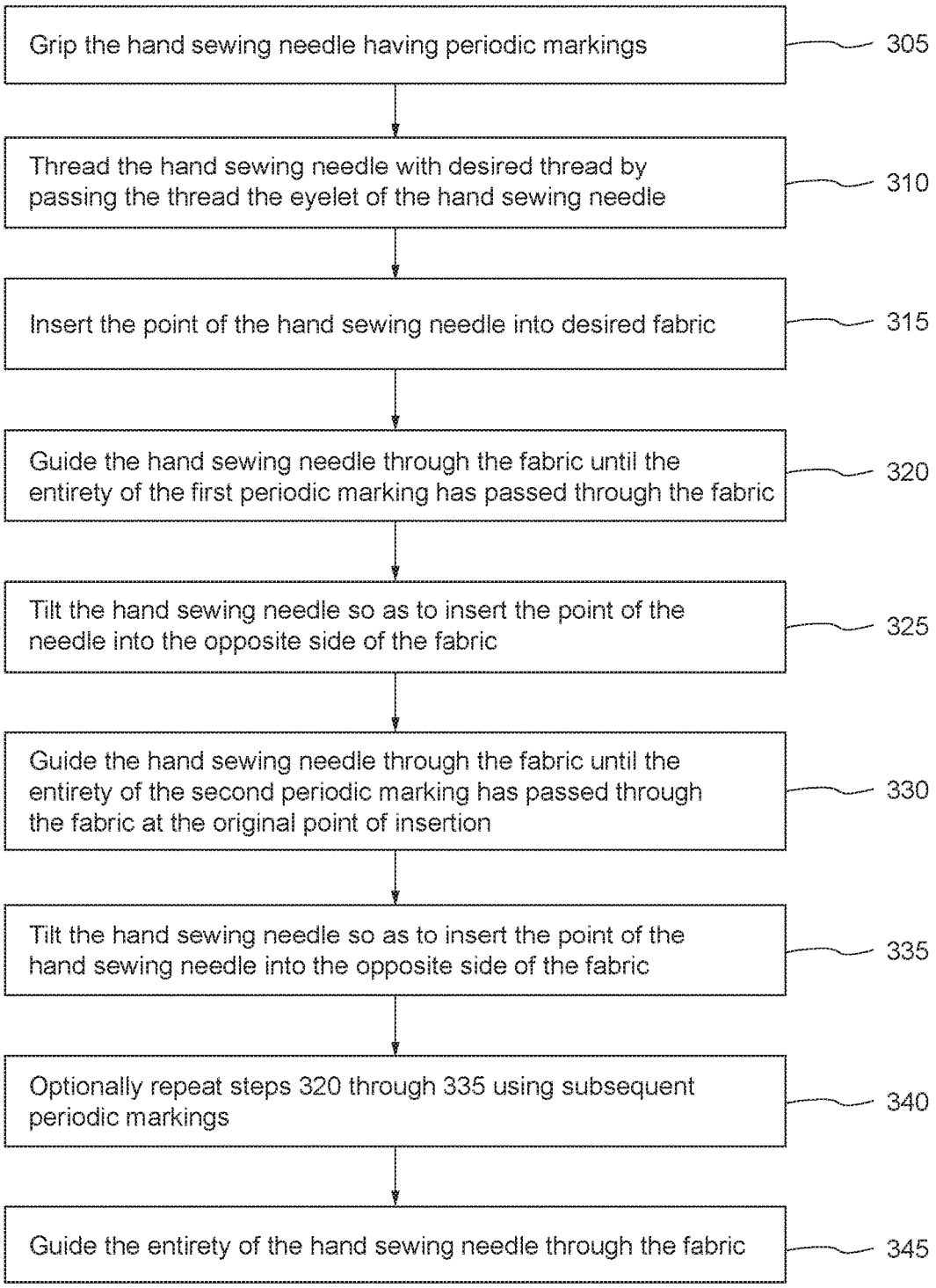
FIG. 3 shows an exemplary flow for a process of use of the hand sewing needle of FIG. 1 in accordance with embodiments of the present invention.

Some embodiments of the invention are directed to a process for using the above-described hand sewing needle having periodic markings. FIG. 3 shows an exemplary flow diagram for a process of using a hand sewing needle, such as needle 100 of FIG. 1. The flow diagram illustrates a method of straight stitching, a type of stitching. Examples of other types of stitches that may be made using the hand sewing needle include running stitches, hemming stitches, basting stitches, catch stitches, backstitches, and the like. Furthermore, the flow diagram of FIG. 3 illustrates a process that creates stitches of equal length and spacing such that the length and spacing of each stitch is equivalent to the length of one periodic marking on the needle. It is contemplated that the process may be adjusted to change the length or the spacing of the stitches, e.g., either or both of the length and/or the spacing may be equivalent to the length of two, three, four, etc., periodic markings.

At step 305, the user grips the disclosed hand sewing needle. In the process of this flow diagram, the embodiment of the needle that is used is a hand sewing needle with two sets of periodic markings, each set taking the form of thick stripes, the stripes of each set being of equal length and immediately adjacent on the elongated body to a stripe of the opposite set. The process may be used, however, with other embodiments of the needle. At step 310, the user threads the needle with a desired piece of thread by passing the thread through the eyelet of the needle. The type of thread used is not limited, but the thread is preferably narrow enough to pass through the eyelet of the needle. The thread may be passed through the eyelet by hand or with use of a threading device. Exemplary needle threading devices make use of a wire loop to pull thread through the eyelet of a needle. At step 315, the point of the sewing needle is inserted into a desired piece of fabric. The types of fabric used is not limited. The location at which the user pierces the fabric is not limited and may be informed by the sewing project. At step 320, the user guides the sewing needle through the fabric, e.g., by pushing or pulling, until the entirety of the first periodic marking has passed through the fabric. The needle is then tilted, at step 325, to reinsert the point of the needle into the opposite side of the fabric. The needle may be tilted such that the needle is lain substantially flat on the fabric, but other methods of tilting or readjusting the needle may be used. In some embodiments, the needle does not pass through the fabric any further while being tilted. This ensures regularity in stitching. At step 330, the needle is further guided through the fabric at this second point of insertion. The needle is guided, e.g., by pushing or pulling, through the fabric only until the entirety of the second periodic marking has passed through the first point of insertion. Because the periodic markings of this embodiment are of equivalent length, the entirety of the first periodic marking has also passed through the second point of insertion. At step 335, the needle is once again titled and inserted into the opposite side of the fabric. In this way, the user has created stitches of equal length. The periodic markings provide an indication to the user of the length of the needle that has passed through the fabric, and, because the periodic markings are each of equivalent length, by passing the needle through the fabric at intervals corresponding to the periodic markings, the user can create regular stitches. Optional step 340 allows for the user to create additional stitches of equal length by repeating steps 320 through 335 in reference to the subsequent periodic markings, i.e., the third, fourth, fifth, etc. periodic markings. At step 345, the entirety of the hand sewing needle is guided through the fabric. What remains is regular stitches, the length and spacing of which are each equivalent to the length of the periodic markings. The user may continue this chain of regular stitches by beginning the process again at 315, and the point of insertion may be determined by piercing the fabric at a distance equivalent to one periodic marking from the last stitch. In this way, the user may complete an entire sewing project with regular stitches. Although described herein and being configured and used to create regular stitches of equivalent length, it is contemplated that in some embodiments, periodic markings of different lengths may instead be used to create patterned stitches.

Figure 4:
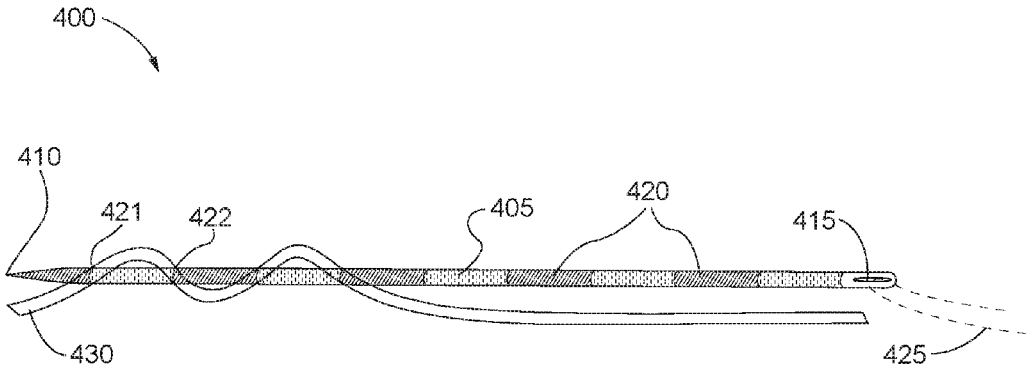
FIG. 4 shows a side view of the hand sewing needle of FIG. 1, shown with thread and fabric and demonstrating a method of use in accordance with embodiments of the present invention.
Figure 5:
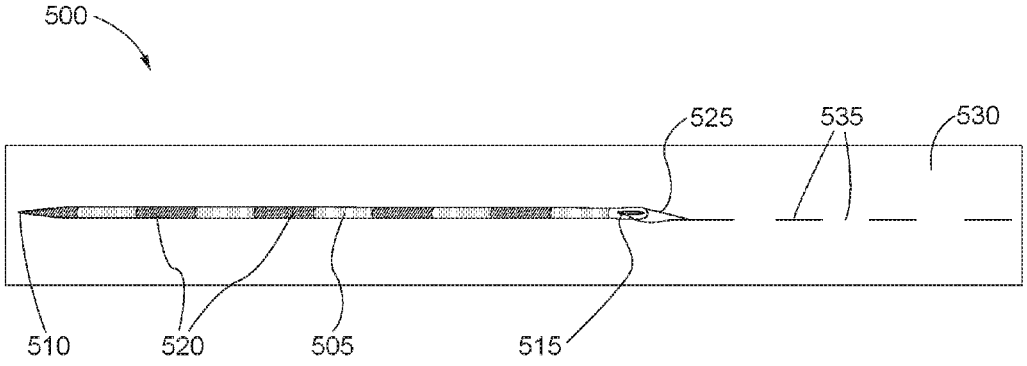
FIG. 5 shows a perspective top view of the hand sewing needle of FIG. 1, shown with thread and fabric and demonstrating the resulting stitches of use in accordance with embodiments of the present invention.

FIG. 4 shows a side view of the hand sewing needle during the process illustrated by the flow diagram of FIG. 3 according to some embodiments. Specifically, FIG. 4 shows the needle at optional step 340. FIG. 5 shows the result of the process illustrated by the flow diagram of FIG. 3. As shown in FIG. 5, this process of use results in regular stitches 535 of even length and spacing.

In the foregoing specification, aspects of the invention are described with reference to specific embodiments thereof, but those skilled in the art will recognize that the invention is not limited thereto. Various features and aspects of the above-described invention may be used individually or jointly. Further, embodiments can be utilized in any number of environments and applications beyond those described herein without departing from the broader spirit and scope of the specification. The specification and drawings are, accordingly, to be regarded as illustrative rather than restrictive.

In the foregoing description, for the purposes of illustration, methods were described in a particular order. It should be appreciated that in alternate embodiments, the methods may be performed in a different order than that described. While illustrative embodiments of the application have been described in detail herein, it is to be understood that the inventive concepts may be otherwise variously embodied and employed, and that the appended claims are intended to be construed to include such variations, except as limited by the prior art.

I claim:

1. A needle, comprising:

an elongated body comprising a metal, the elongated body having a first end and a second end, wherein said elongated body extends between the first end and the second end and wherein the elongated body includes a point at the first end;

an eyelet positioned within the elongated body at the second end; and periodic markings along the elongated body between the first end and second end, wherein the periodic markings are spaced along the elongated body with a predetermined distance between each periodic marking, wherein the distance between each periodic marking is filled by additional sets of supplemental periodic markings, and wherein the periodic markings and the supplemental periodic markings have differing degrees of oxidation.

2. The needle of claim 1, wherein the periodic markings are stripes extending about a circumference of the elongated body.

3. The needle of claim 2, wherein a width of the stripes is equal to the distance between each periodic marking.

4. A method of producing a needle comprising:

providing the needle, wherein the needle comprises an elongated body comprising a metal, the elongated body having a first end and a second end, wherein said elongated body extends between the first end and the second end wherein the elongated body includes a point at the first end, and wherein the needle further comprises an eyelet positioned within the elongated body at the second end;

creating periodic markings on the elongated body between the first end and the second end by oxidizing portions of the elongated body, and creating supplemental periodic markings on the elongated body by oxidizing the distance between each periodic marking.

5. A method of using a needle, comprising:

providing the needle, wherein the needle comprises an elongated body comprising a metal, the elongated body having a first end and a second end, wherein said elongated body extends between the first end and the second end, wherein the elongated body includes a point at the first end, wherein the needle further comprises an eyelet positioned within the elongated body at the second end, and wherein the needle further comprises a plurality of periodic markings along the elongated body between the first end and second end, wherein the plurality of periodic markings are spaced along the elongated body with a predetermined distance between each of the plurality of periodic markings, wherein the distance between each periodic marking is filled by additional sets of supplemental periodic markings, and wherein the periodic markings and the supplemental periodic markings have differing degrees of oxidation;

threading the needle with thread by passing the thread through the eyelet of the needle;

inserting the point of the needle into fabric at a first location;

guiding the needle through the fabric until a first periodic marking of the plurality of periodic markings has entirely passed through the fabric;

tilting the needle;

inserting the point of the needle into the fabric at a second location; and guiding the needle through the fabric until a second periodic marking of the plurality of periodic markings has entirely passed through the fabric.

6. The method of claim 4, wherein the periodic markings and the supplemental periodic markings are oxidized at differing voltages.

* * * * *